US007111842B2

(12) United States Patent
Taku

(10) Patent No.: US 7,111,842 B2
(45) Date of Patent: Sep. 26, 2006

(54) PRINTING APPARATUS AND SHEET CARTRIDGE

(75) Inventor: Masakazu Taku, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 549 days.

(21) Appl. No.: 10/461,350

(22) Filed: Jun. 16, 2003

(65) Prior Publication Data

US 2003/0234486 A1 Dec. 25, 2003

(30) Foreign Application Priority Data

Jun. 21, 2002 (JP) ..... 2002-182159

(51) Int. Cl.
*B65H 9/12* (2006.01)

(52) U.S. Cl. ..... 271/241

(58) Field of Classification Search ..... 271/241, 271/147, 160; 347/104
See application file for complete search history.

(56) References Cited

U.S. PATENT DOCUMENTS 3,417,988 A * 12/1968 Springer ..... 271/19
4,429,865 A * 2/1984 Okada ..... 271/170
4,595,191 A * 6/1986 Uchiyama et al. ..... 271/170
5,152,622 A * 10/1992 Rasmussen et al. ..... 400/579
5,188,353 A 2/1993 Parks ..... 271/184
6,523,933 B1 * 2/2003 Hirano et al. ..... 347/36

FOREIGN PATENT DOCUMENTS

JP 11 254700 A * 9/1999
JP 3180819 4/2001

* cited by examiner

*Primary Examiner*—Joseph C. Rodriguez
(74) *Attorney, Agent, or Firm*—Fitzpatrick, Cella, Harper & Scinto

(57) ABSTRACT

In a sheet feeding mechanism wherein a spring can be used to properly regulate a sheet feeding position, sheets are not deformed in spite of the urging force of the spring, and a required conveying force is prevented from being increased after sheet feeding. Specifically, immediately before a sheet is fed, a driving mechanism is used to move a slide plate leftward. A driving portion of the slide plate pushes an arm of a lever to rotate the lever counterclockwise against a tension spring. Thus, a connecting portion of the lever pushes an interlocking portion of a biasing plate downward. That part of the biasing plate rotates clockwise against the force exerted as a set spring portion is urged counterclockwise. In conjunction with this rotation, a biasing portion rotates clockwise to urge printing sheets to press them against a reference surface of a case.

11 Claims, 8 Drawing Sheets

PRINTING APPARATUS AND SHEET CARTRIDGE

This application claims priority from Japanese Patent Application No. 2002-182159 filed Jun. 21, 2002, which is incorporated hereinto by reference.

BACKGROUND OF THE INVENTION

1. Field of the Invention

The present invention relates to a printing apparatus and a sheet cartridge, and more specifically to a mechanism that feeds printing sheets in a printing apparatus such as a printer or a copying machine.

2. Description of the Related Art

Conventional sheet feeding mechanisms of this type are provided with a mechanism for properly maintaining a conveying position or posture of a sheet during sheet feeding. The mechanism enables the sheet to be prevented from slant moving so that printing is executed to an accurate position of the sheet during printing operation, which accompanies conveying of the sheet after sheet feeding.

For example, in a known sheet feeding mechanism of a printer, a pair of guide members is fixedly provided so that the distance between the guide members is slightly larger than the width of sheets. This arrangement serves to regulate the sheet feeding direction or position of the sheets. Further, in another known form, one of the guide members can be moved depending on the size of sheets, while the sheets can be pressed against the other guide member. Furthermore, as described in, for example, Japanese Patent No. 3180819, a copying machine provided with a tamper is known wherein when sheets are stacked on a feeding section, the tamper biases the sheets in a direction crossing the sheet feeding direction and presses the sheets as in the case with the above guide members.

However, the size of sheets such as their width may vary slightly. In this case, if the guide members are fixedly provided as in the above conventional example, looseness may be created between the guide members and the sheets in accordance with the variation of the sheet width. Consequently, the sheets may be inclined in the conveying direction of the sheet.

Further, also in the form in which the guide member or the damper is pressed against a sheet, the guide member may be shifted because of the weight of sheets depending on the position of the printer because no urging force is basically exerted after the pressing. As a result, the sheets are inclined when fed. For example, if a sheet cartridge (cassette) is installed in a relatively small-sized portable printer, the load a few or several times the weight of sheets due to a vibration or a shock caused by carrying of the printer may act on the guide members, depending on the position of the printer when it is carried. Thus, the guide members may be shifted to incline the sheet feeding direction.

To solve this problem, it is considered that a spring may be used to urge and press the guide members against sheets. However, in a configuration in which this urging force always acts on the sheets, the sheets may be deformed, e.g. curled. Consequently, the relative positions of the sheets and, for example, a print head may deviate from the original ones to reduce the accuracy of a print position. Further, if this urging force is allowed to act during printing, a relatively large force is required to convey fed sheets. This creates problems such as an increase in the power consumption of a relevant motor and as degradation of print quality due to an increase in a slip amount of the conveyed sheet.

SUMMARY OF THE INVENTION

It is an object of the present invention to provide a printing apparatus and a sheet cartridge which can use a spring to properly regulate a sheet feeding position such as a sheet feeding direction and which prevents sheets from being deformed in spite of the urging force of the spring, a conveying force required after sheet feeding from being increased, and a slip amount of the sheet conveyed from increasing.

In the first aspect of the present invention, there is provided a printing apparatus including a sheet feeding mechanism and a conveying mechanism for conveying a sheet fed by the sheet feeding mechanism and performing printing on the sheet which is conveyed by the conveying mechanism, the apparatus comprising:

urging means for urging the sheet fed in the sheet feeding mechanism in a direction different from a feeding direction of the sheet so as to press the sheet against a predetermined reference surface; and control means for controlling the urging means so that the urging means starts the urging at least before the sheet feeding means exerts a conveying of the sheet for feeding.

In the second aspect of the present invention, there is provided a printing apparatus using a sheet cartridge, in which sheet are housed and which is installed in the apparatus, the installing the sheet cartridge causing a sheet feeding mechanism to be formed, including a conveying mechanism for conveying the sheet fed by the sheet feeding mechanism, and performing printing on the sheet which is conveyed by the conveying mechanism, the apparatus comprising:

urging means, which is formed by installing the sheet cartridge, urging the sheet fed in the sheet feeding mechanism in a direction different from a feeding direction of the sheet so as to press the sheet against a predetermined reference surface; and control means for controlling the urging means so that the urging means starts urging at least before the sheet feeding mechanism performs conveying of the sheet for feeding.

Here, the control means may control the urging means so that the urging means perform urging at least until the conveying mechanism starts conveying of the sheet.

In the third aspect of the present invention, there is provided a printing apparatus using a sheet cartridge, in which sheet are housed and which is installed in the apparatus, the installing the sheet cartridge causing a sheet feeding mechanism to be formed, including a conveying mechanism for conveying the sheet fed by the sheet feeding mechanism, and performing printing on the sheet which is conveyed by the conveying mechanism, the apparatus comprising:

a first actuating member engaging with a first member of the sheet cartridge installed to form the sheet feeding mechanism; and a second actuating member engaging with a second member of the sheet cartridge installed for forming urging means, which includes a spring member to urge the sheet to be fed by the sheet feeding mechanism in a direction different from a feeding direction of the sheet so as to press the sheet against a predetermined reference surface, wherein the first and second actuating members are configured so that the urging means starts urging at least before the sheet feeding mechanism performs conveying of the sheet for feeding.

In the fourth aspect of the present invention, there is provided a sheet cartridge in which sheets are housed and which is used by a printing apparatus including a sheet feeding mechanism and a conveying mechanism for conveying a sheet fed by the sheet feeding mechanism and performing printing on the sheet which is conveyed by the conveying mechanism, the cartridge comprising:

a first member engaging with a first actuating member of the printing apparatus upon installation of the sheet cartridge to form the sheet feeding mechanism, and a second member engaging with a second actuating member of the printing apparatus upon installation of the sheet cartridge to form urging means, which includes a spring member to urge the sheet to be fed by the sheet feeding mechanism in a direction different from a feeding direction of the sheet so as to press the sheet against a predetermined reference surface, wherein the first and second members are configured so that the urging means starts urging at least before the sheet feeding mechanism performs conveying of the sheet for feeding.

With this structure, the urging operation is performed to urge the printing sheets fed in the sheet feeding mechanism in the direction different from the sheet feeding direction to press them against the predetermined reference surface. This urging operation is started at least before one of the sheets is conveyed by the feeding mechanism so as to feed the sheet. Further, the urging operation is preferably performed at least until the conveying means starts conveying the sheet. Consequently, at least when the sheet is fed, its position such as its feeding direction can be regulated by exerting urging force on it. Furthermore, it is possible that the urging operation is performed immediately before the sheet is fed and not on the other occasions, particularly while the sheet is housed before being fed. It is also possible that the urging operation is performed only during a sheet feeding operation and not while the sheet is subsequently conveyed and printed.

The above and other objects, effects, features and advantages of the present invention will become more apparent from the following description of embodiments thereof taken in conjunction with the accompanying drawings.

DETAILED DESCRIPTION OF PREFERRED EMBODIMENTS

An embodiment of the present invention will be described below in detail with reference to the drawings.

Figure 1:
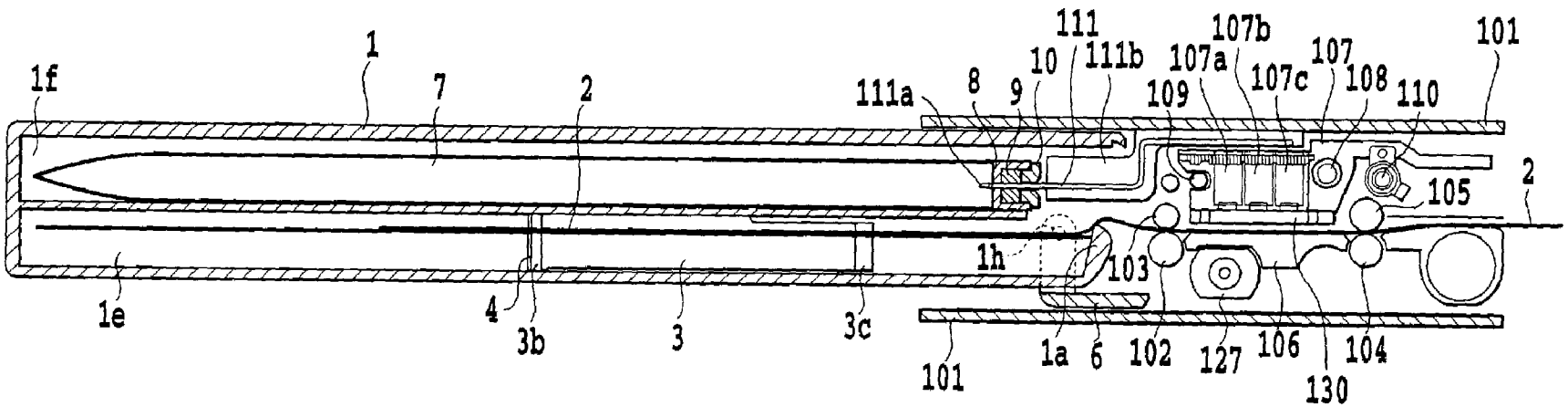
FIG. 1 is a sectional view of the main part of the configuration of an ink jet printer according to an embodiment of the present invention as viewed from its side.

FIG. 1 is a sectional view of the main part of the configuration of an ink jet printer according to an embodiment of the present invention as viewed from its side.

The printer according to the present embodiment is relatively small-sized and portable one. It is composed of two parts including a sheet cartridge and a printer main body the external shapes of which are generally defined by a sheet cartridge case 1 and a printer chassis 101, respectively. The sheet cartridge contains sheets 2 and an ink bag 7 that stores ink used for printing by the printer main body. The sheet cartridge is detachably installed in the printer main body. Thus, the sheet cartridge can be replaced with a new one once a predetermined number of sheets housed have been used up or the ink inside the ink bag has been exhausted.

As shown in FIG. 1, the sheet cartridge case 1 comprises a chamber 1*e* in which the printing sheets 2 are housed and a chamber 1*f* in which the ink bag 7 is housed. When the sheet cartridge case 1 is installed on the printer chassis 101, it is possible to feed the sheets 2 housed in the chamber 1*e* and to supply the ink in the ink bag 7 housed in the chamber 1*f*. Further, the installation of the sheet cartridge case 1 enables the operation of a biasing plate 3 used to regulate the feeding direction of the sheets 2 or the like during sheet feeding, as described later in detail. A well-known arrangement can be used to install or remove the sheet cartridge in or from the printer main body. Its detailed description is omitted.

Figure 2:
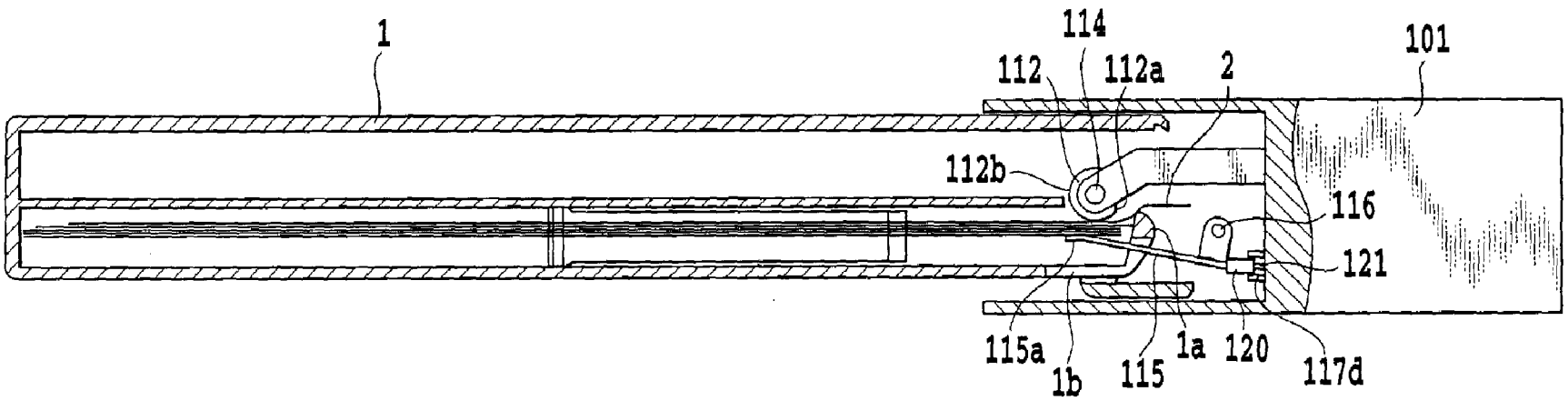
FIG. 2 is a view showing the details of a sheet feeding mechanism formed in the printer.

The printing sheets 2 housed in the chamber 1*e* are separated from one another by a separating convex 1*a* and a sheet feeding roller 112 (see FIG. 2). Then the separated sheet is fed to a conveying mechanism of the printer main body. The conveying mechanism provided in the printer chassis 101 is mainly composed of a pair of a conveying roller 102 and a pinch roller 103 and a pair of a sheet discharging roller 104 and a discharging pinch roller 105 which are provided downstream of the pair of rollers 102, 103 in a conveying direction. A platen 106 is disposed along the conveying path between these pairs of rollers to flatten a print surface of the printing sheet 2 conveyed on the platen 106.

An area opposite the platen 106 corresponds to an area scanned by a printing head 130. More specifically, the printing head 130 is installed on a carriage 107, and the carriage 107 is configured to be supported by shafts 108 and 109 and be reciprocated in a direction perpendicular to the sheet of the drawing. Further, on the carriage 107 not only the printing head 130 but also ink tanks 107*a*, 107*b*, and 107*c* that store ink supplied to the print head 130 are installed. Thus, as the carriage 107 is moved, the printing head 130 can be driven in accordance with printing data to eject the ink onto the sheet 2. Then, by repeating the scanning of the printing head 130 and the conveyance of the sheet 2 by a predetermined amount, characters, images, or the like can be printed on the entire sheet 2.

The tanks store cyan, magenta, and yellow inks, respectively. The printing head 130 comprises ejection opening arrays each composed of a predetermined number of ejection openings, correspondingly to these three types of ink. Each of the ejection openings is provided with a heater, which is an elctro-thermal converter, disposed in an ink path in communication with the ejection opening. The ink is caused to generate a bubble utilizing thermal energy generated by the heater when it is driven. Then, the pressure of the bubble causes the ink to be ejected. Further, the carriage 107 can be moved by a carriage driving mechanism including a lead screw 110 provided parallel with the shafts 108 and 109 and a driving mechanism such as a motor driving the lead screw. Further, a motor 127 provided under the platen 106 provides driving force serving to operate the biasing plate 3 as described later.

The printer chassis 101 is further provided with a joint mechanism 111. The joint mechanism 111 is formed of pipe materials to supply ink from the ink bag 7 in the sheet cartridge 1 to the ink tanks 107*a* to 107*c* on the carriage 107. The joint mechanism 111 is held by a fixing section 111*b* and fixed to the printer chassis 1101.

Figure 8:
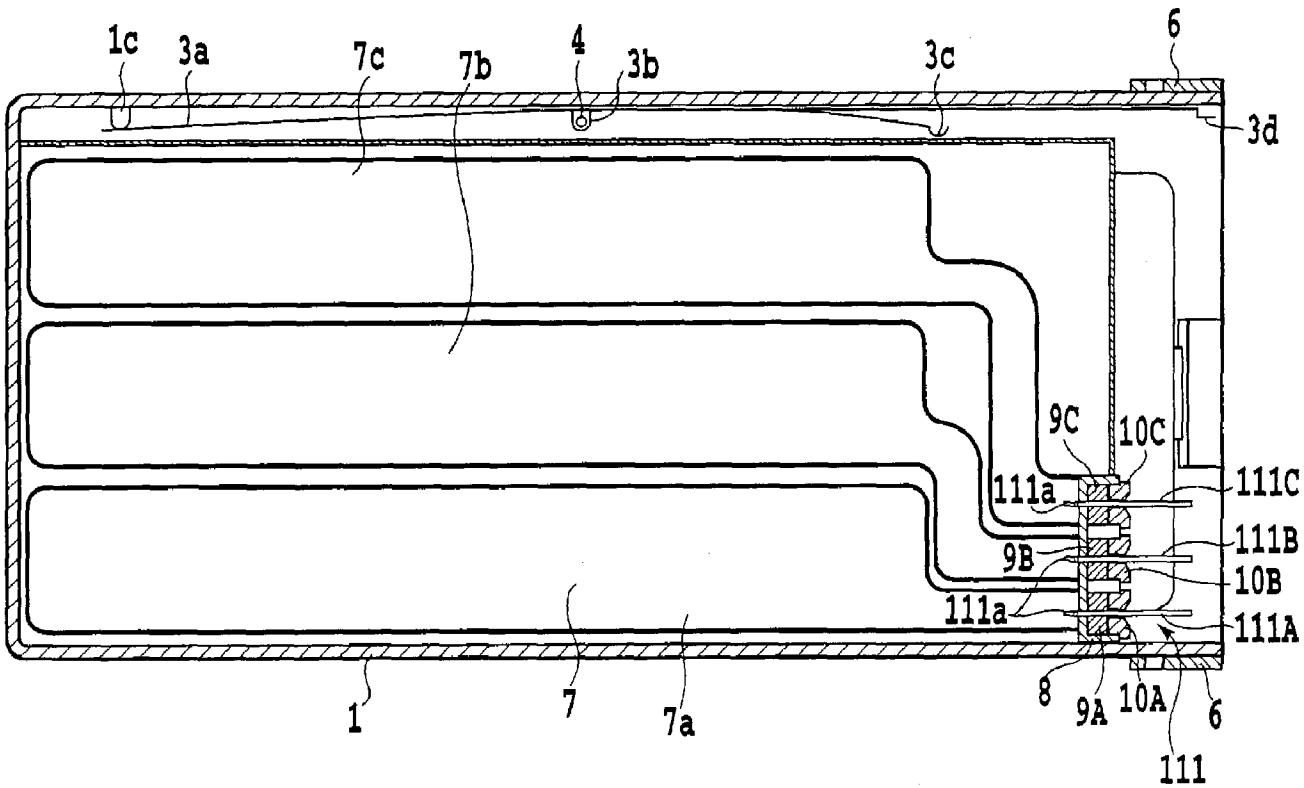
FIG. 8 is a view illustrating a joint used to supply ink in this printer.

As shown in FIG. 8 that is a sectional view of the sheet cartridge case 1 as viewed from above, the joint mechanism 111 is composed of three needles 111A, 111B, and 111C corresponding to the cyan, magenta, and yellow inks. The fixing section 111*b* holds these three needles 111A, 111B, and 111C together and fixes them to the printer chassis 101. Specifically, the joint mechanism 111 has the joint needles 111A, 111B, and 111C corresponding to ink bags 7*a*, 7*b*, and 7*c*, respectively. Thus, the ink bags 7*a*, 7*b*, and 7*c*, storing cyan, magenta, and yellow inks, respectively, can be connected to the ink tanks 107*a* to 107*c*, respectively, for ink supply. Each needle of the joint mechanism 111 has a pointed needle portion 111*a* and a side hole for defining a liquid path, which are formed at a tip of the needle. In conjunction with the installation of the sheet cartridge 1 in the printer main body, the needles 111A, 111B, and 111C piece joint rubbers 9A, 9B, and 9C, respectively, sandwiched between a holder 8 and guide hole members 10A, 10B, and 10C for the respective inks to accomplish the above connection, the holder 8 integrally constituting a joint portion for the ink bags.

Referring back to FIG. 1, the biasing plate 3 is formed of a plate spring material. A flange portion 3*b* of the biasing plate 3 is rotatably supported by a shaft 4 fixed to the sheet cartridge case 1.

Figure 3:
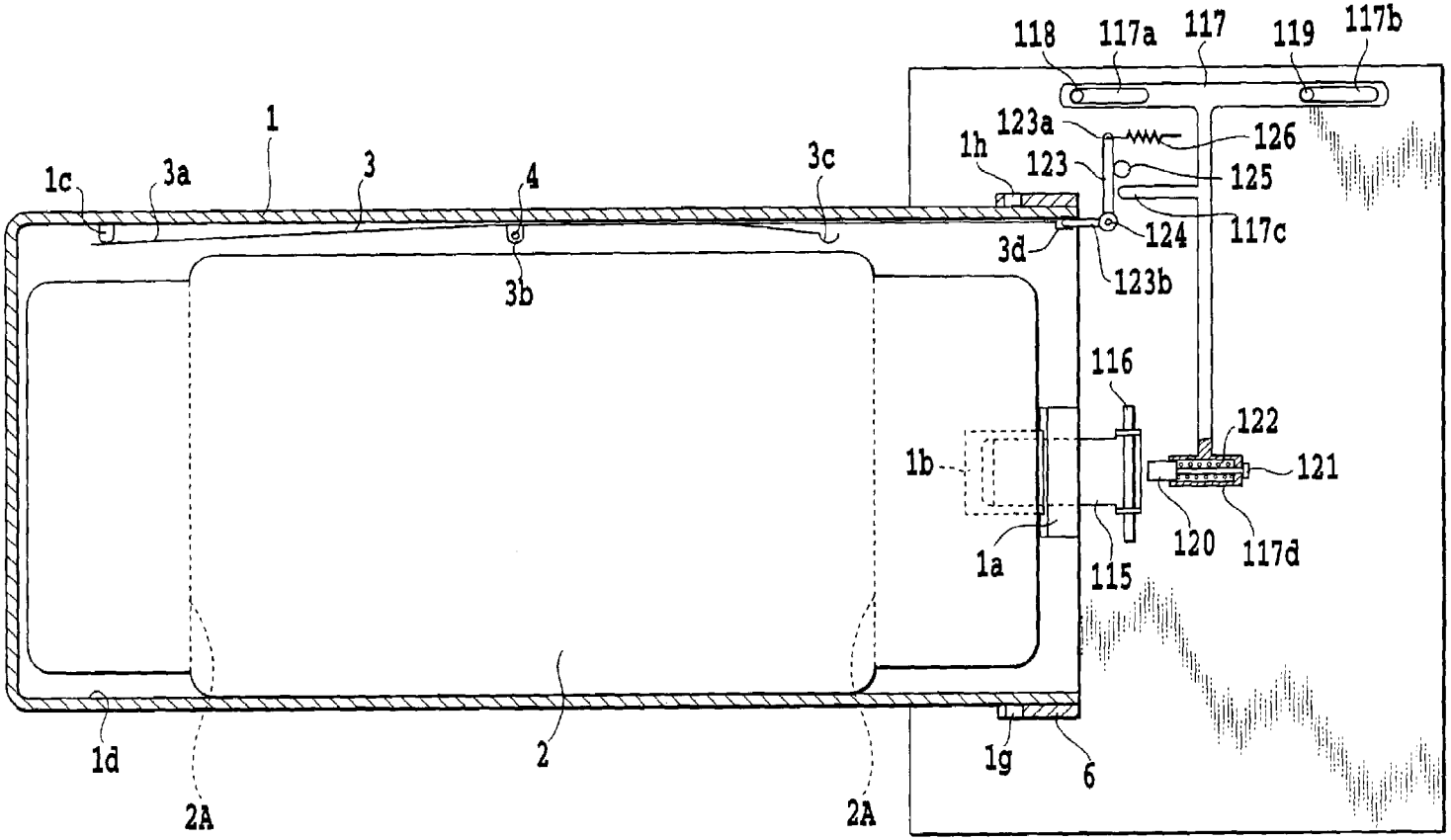
FIG. 3 is a view illustrating the details of a connection associated with the installation of a sheet cartridge in this printer and required for the operation of a biasing plate.
Figure 7:
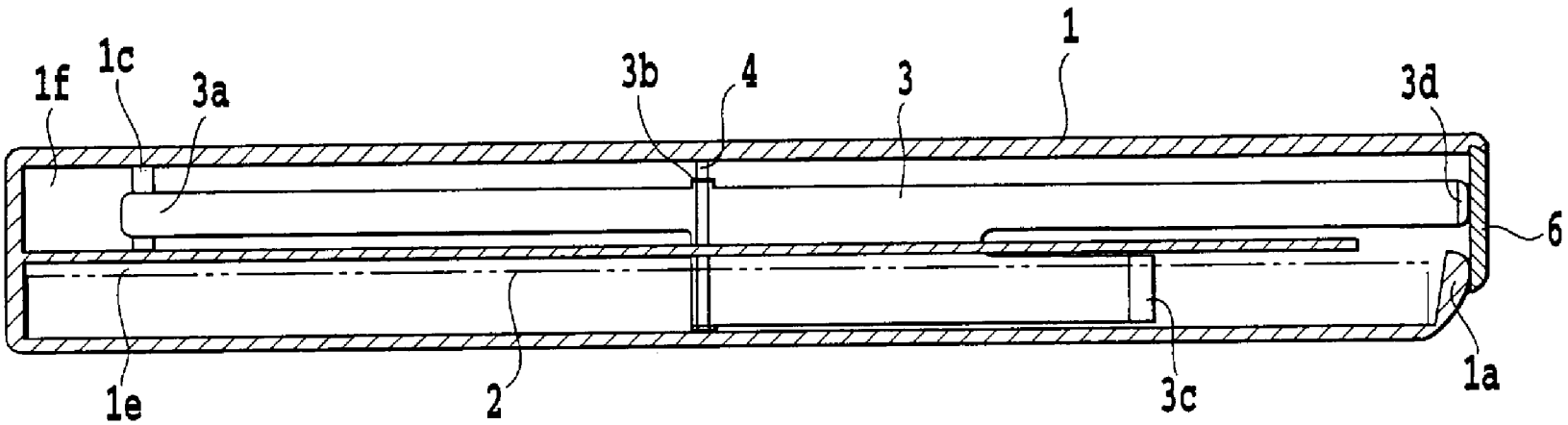
FIG. 7 is a view showing the structure of the biasing plate.

FIG. 7 is a sectional view of the sheet cartridge case 1, showing the structure of the biasing plate 3. As shown in this figure, in addition to the flange portion 3*b* supported by the shaft 4 as described above, the biasing plate 3 includes a set spring portion 3*a*, a biasing portion 3*c*, and an interlocking portion 3*d*. As shown in FIG. 3, the set spring portion 3*a* abuts against the convex 1*c* of the sheet cartridge case 1. Thus, the entire biasing plate 3 is always urged so as to rotate counterclockwise with respect to the shaft 4. The biasing portion 3*c*, formed opposite the set spring portion 3*a* with respect to the rotating shaft 4, moves clockwise as the interlocking portion 3*d* is moved. Accordingly, the sheets 2 stacked in the chamber 1*e* are urged in a direction generally orthogonal to the sheet feeding direction. The sheets 2 can thus be biased. The interlocking portion 3*d* moves in response to the movement of a lever 123 (FIG. 3) provided in the printer main body as described later in FIG. 3. Thus, the biasing portion 3*c*, integrated with the interlocking portion 3*d*, can perform an urging operation for the above biasing.

The biasing plate 3 is configured as described below. The set spring portion 3*a* and interlocking portion 3*d* of the biasing plate 3 are arranged in the chamber 1*f* of the sheet cartridge 1, in which the ink bags are housed, so that their movements will not interfere with the printing sheets 2. The biasing portion 3*c* is arranged in the chamber 1*e*, in which the printing sheets 2 are housed, so as to abut against the printing sheets 2. Further, the width of the biasing portion 3*c* (a vertical length in FIG. 7) corresponds to the full height of the maximum number of sheets stacked together and is thus enough to urge these sheets. In the present embodiment, only one biasing portion 3*c* is provided. However, a plurality of biasing portions 3*c* may be provided along the length direction (sheet feeding direction) of the stacked sheets. Furthermore, the biasing portion 3*c* is formed integrally of a spring member. However, it should be appreciated that a resin material may be used in that part of the biasing plate which is contacted with the sheet so as not to make a flaw such as a dent in the side of the sheet and so as to reduce loads imposed by biasing during sheet feeding.

Referring back to FIG. 1, reference numeral 6 denotes an opening and closing door. When the sheet cartridge is removed from the printer chassis 101, the opening and closing door 6 is manually closed using shafts 1*g* and 1*h* (see FIGS. 1 and 3) as an axis of rotation as shown in FIG. 7. This prevents dirt from adhering to the joint rubbers 9A, 9B, and 9C and also prevents the printing sheets 2 from slipping out of the cartridge case 1. On the other hand, when the cartridge is installed on the printer chassis 101, in contrast with the operation of manually closing the door, the door is opened by rotating, in FIG. 1, it clockwise through 90° to establish the condition shown in this figure. This makes it possible to join the ink to the ink tank and to feed the printing sheets 2.

A mechanism (its essential parts are not shown in FIG. 1) for feeding the sheets 2 is formed by installing the sheet cartridge on the printer chassis 101 as in the case with the joint for ink supply as described above.

FIG. 2 is a view showing the detail of the sheet feeding mechanism formed.

In this figure, reference numeral 112 denotes a sheet feeding roller that is supported so as to be rotatable using a shaft 114 of an arm 113. The sheet feeding roller 112 has a D-shaped cross section. Thus, as the sheet feeding roller 112 is rotated, the sheets are opposed by a straight D cut portion 112*a* that is not involved in sheet feeding and a circular portion 112*b* involved in sheet feeding. Reference numeral 115 denotes a pressure plate. A projecting portion of the pressure plate 115 is rotatively supported by a rotating shaft 116 fixed to the printer chassis 101. The pressure plate 115 can be pushed leftward by a pressing member 120 to rotate clockwise around the rotating shaft 116, and a pressing portion 115*a* of the pressure plate 115 can press the sheets toward the sheet feeding roller 112. The sheet feeding roller 112 is rotated in a condition that the pressure plate 115 presses the sheet 2 against the circular portion 112*b* of the sheet feeding roller 112, so that the sheets 2 are moved toward the printer main body. Then, the sheets abut against the separating convex 1*a* of the sheet cartridge case 1, and the uppermost one of the stacked sheets 2 is separated from the others and then fed.

The sheet feeding roller 112 is driven by similarly transmitting the driving force of a motor (not shown) via a gear train (not shown). Then, once a sheet feeding operation is finished, the sheet feeding roller 112 stops at a rotary position where its D cut portion 112*a* is parallel with the sheet 2. Thus, when the sheet cartridge 1 is removed from the printer chassis 101, the separating convex 1*a* of the cartridge 1 is prevented from interfering with the sheet feeding roller 112 on the chassis 101 or vice versa. Further, when the sheet cartridge case is installed, the pressure plate 115 is controlled so as not be urged by the pressing member 120. Thus, the pressing portion 15*a* of the pressure plate 115 maintains its almost horizontal position, and as the cartridge case 1 is installed, the pressing portion 115*a* enters a hole portion 1*b* and can thus occupy a predetermined position in the sheet feeding mechanism formed. Further, the pressing portion 115*a* is set so as to operate within the range of the hole portion 1*a* of the sheet cartridge 1 to avoid interfering with the sheet cartridge case 1 when pressing the sheets 2 after the sheet cartridge case 1 has been installed.

As in the case with the formation of the sheet feeding mechanism and of the joint for ink supply described above, a connection is established for the operation of the biasing plate 3 as the sheet cartridge is installed.

FIG. 3 shows the details of the connection. In this figure, reference numeral 117 denotes a slide plate having two slots 117*a* and 117*b* formed in apart of it. Positioning pins 118 and 119 fixed to the printer chassis 101 engage with the slots 117*a* and 117*b,* respectively. Thus, the slide plate 117 can slide in the lateral directions of the figure within the range of the slots. The slide plate 117 can be slid by using a motor (not shown) to transmit its driving force through a cam mechanism or the like. A well-known arrangement can be used for this purpose, and its detailed description is omitted.

Further, a lever 123 engaging directly with the biasing plate 3 is provided on that portion of the printer chassis 101 on which the sheet cartridge case 1 is installed. The lever 123 is generally L-shaped. Its bent portion is rotatively supported by a rotating shaft 124 fixed to the printer chassis 101. Consequently, the lever 123 as a whole can be rotated. A tension spring 126 is attached to an end of an arm 123*a* of the lever 123. The other end of the spring is fixed to the printer chassis 101. Consequently, the lever 123 is always urged clockwise. On the other hand, a stopper shaft 125 is fixed at a predetermined position of rotation of the lever 123 resulting from the urging. Thus, the clockwise rotation of the lever 123 is limited to this position. Another arm of the lever 123 is a connecting portion 123*b.* When the case of the sheet cartridge 1 is installed on the printer chassis 101, this arm engages with the interlocking portion 3*d* of the biasing plate 3 in conjunction with this installation of the cartridge.

The slide plate 117 comprises a driving portion 117*c* that abuts against the arm 123*a* of the lever 123, which serves to operate the biasing plate 3, and a holder portion 117*d* that holds the pressing member 120, which drives the pressure plate 115. The pressing member 120 is fitted into the holder portion 117*d* of the slide plate 117 and is urged leftward in the figure by a compression spring 122. In addition, a locking portion 121 is provided at the other end of the pressing member 120 to prevent the pressing member 120 from slipping out of the holder portion 117*d.* With this arrangement, as the slide plate 117 slides leftward, the pressing member 120 abuts against the pressure plate 115. Thus, as described above in FIG. 2, the pressure plate 115 abuts the sheets 2 against the sheet feeding roller 112. In this abutted condition, when the slide plate 117 is moved further leftward, the holder portion 117*d* of the slide plate 117 compresses the compression spring 122. This compression load becomes a rotation torque to generate a pressing force that presses the sheets 2 against the sheet feeding roller 112.

Figure 5:
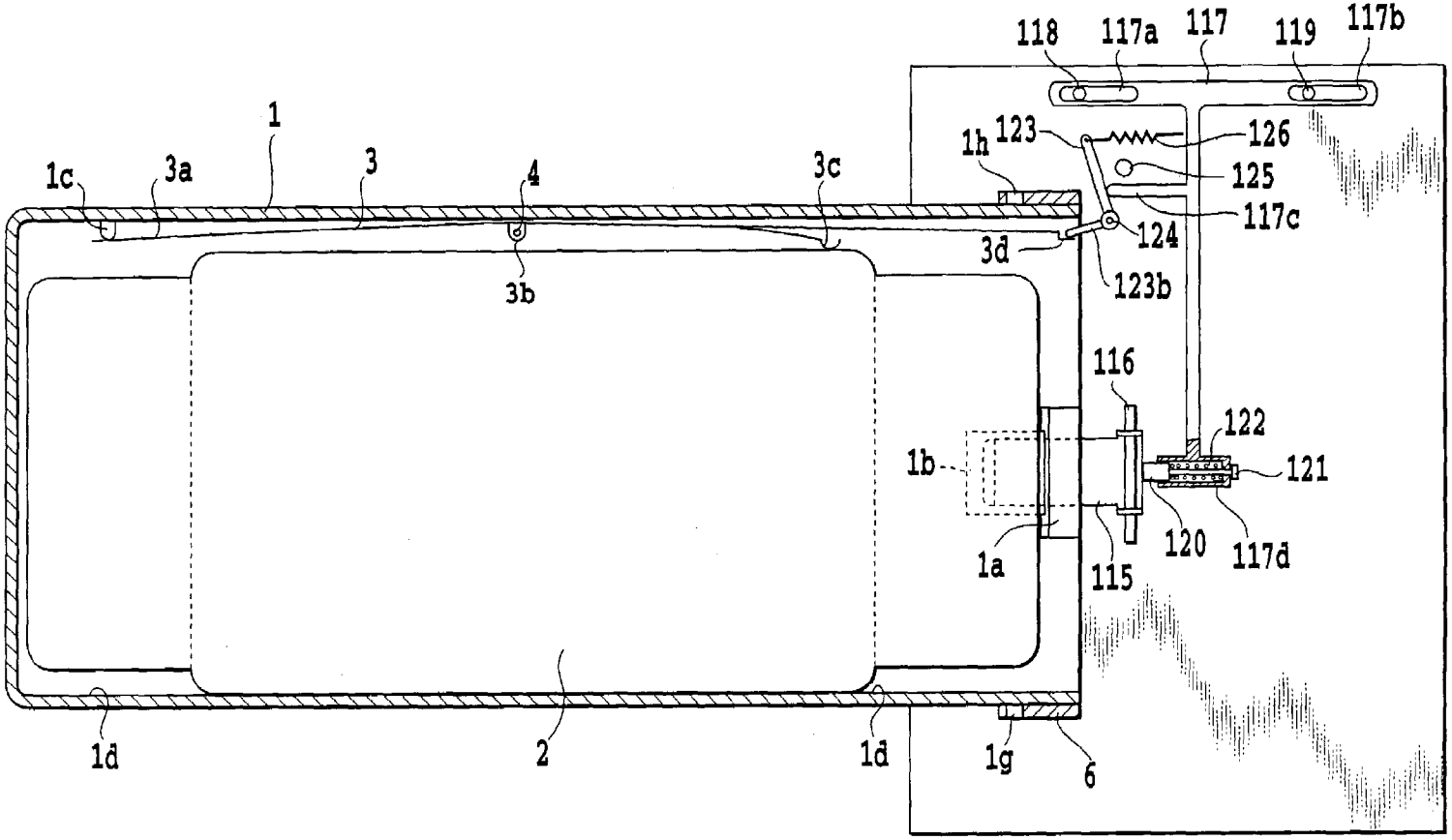
FIG. 5 is also a view illustrating the operation of the biasing plate.
Figure 6:
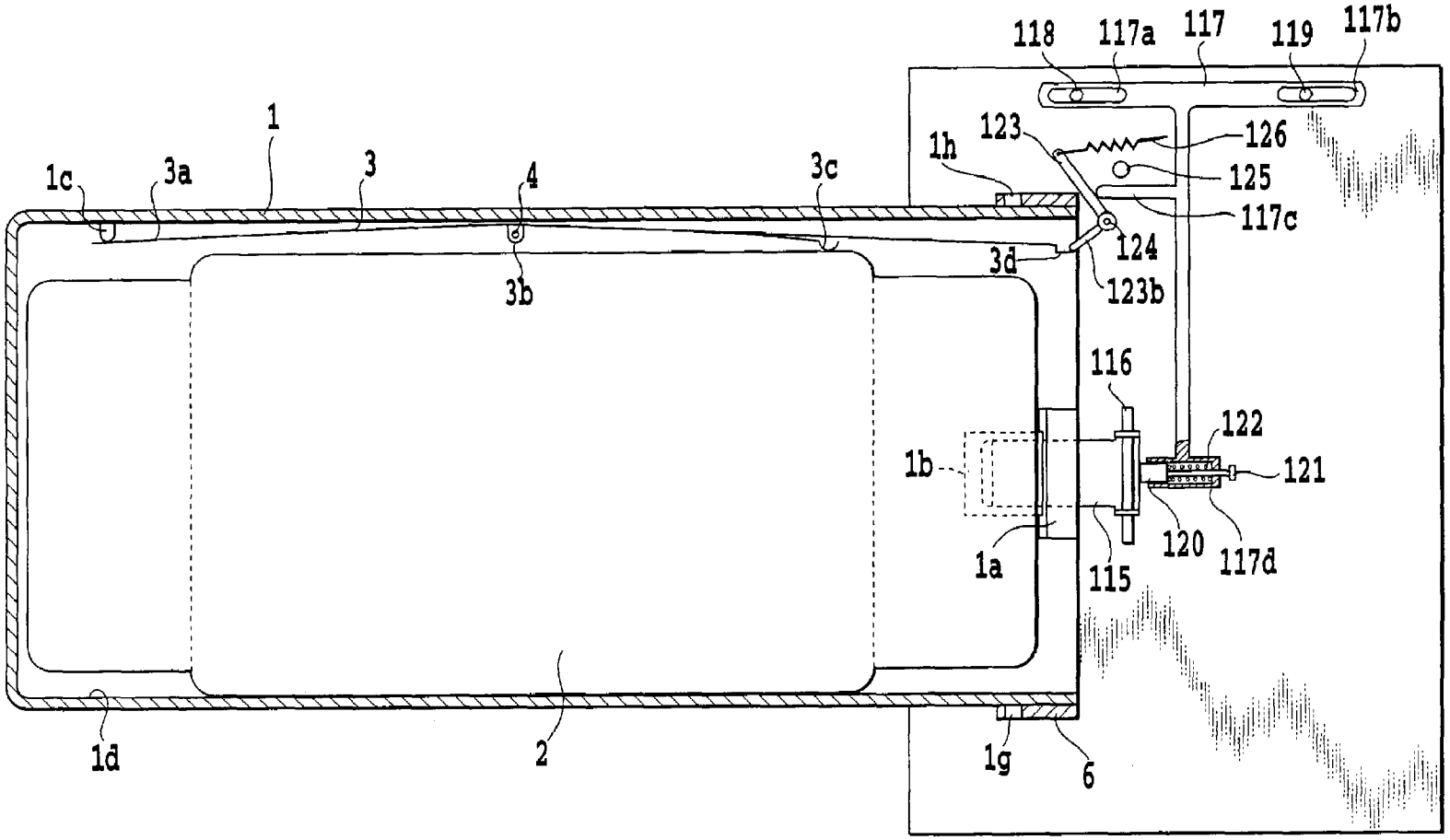
FIG. 6 is also a view illustrating the operation of the biasing plate.

Further, before the pressure plate 115 generates this pressing force, the driving portion 117*c* of the slide plate 117 moves and abuts against the arm 123*a* of the lever 123. Thus, before the pressure plate 115 presses the sheets 2 against the sheet feeding roller, the sheets 2 can be biased. Specifically, the leftward movement of the slide plate 117 causes its driving portion 117*c* to push the arm 123*a* of the lever 123. As the slide plate 117 moves further leftward, the lever 123 is rotated counterclockwise against the tension spring 126, and the connecting portion 123*b* pushes the interlocking portion 3*d* of the biasing plate 3, with which the interlocking portion 3*d* is engaged, downward in the figure. As a result, as shown in FIGS. 5 and 6, the biasing portion 3*c* of the biasing plate 3 performs an operation of pressing the sheets 2 downward in the figure, i.e. a biasing operation while the pressure plate is not exerting any pressing force.

Next, detailed description will be given mainly of a sheet feeding operation involving a biasing operation performed in the printer of the present embodiment described above.

Figure 4:
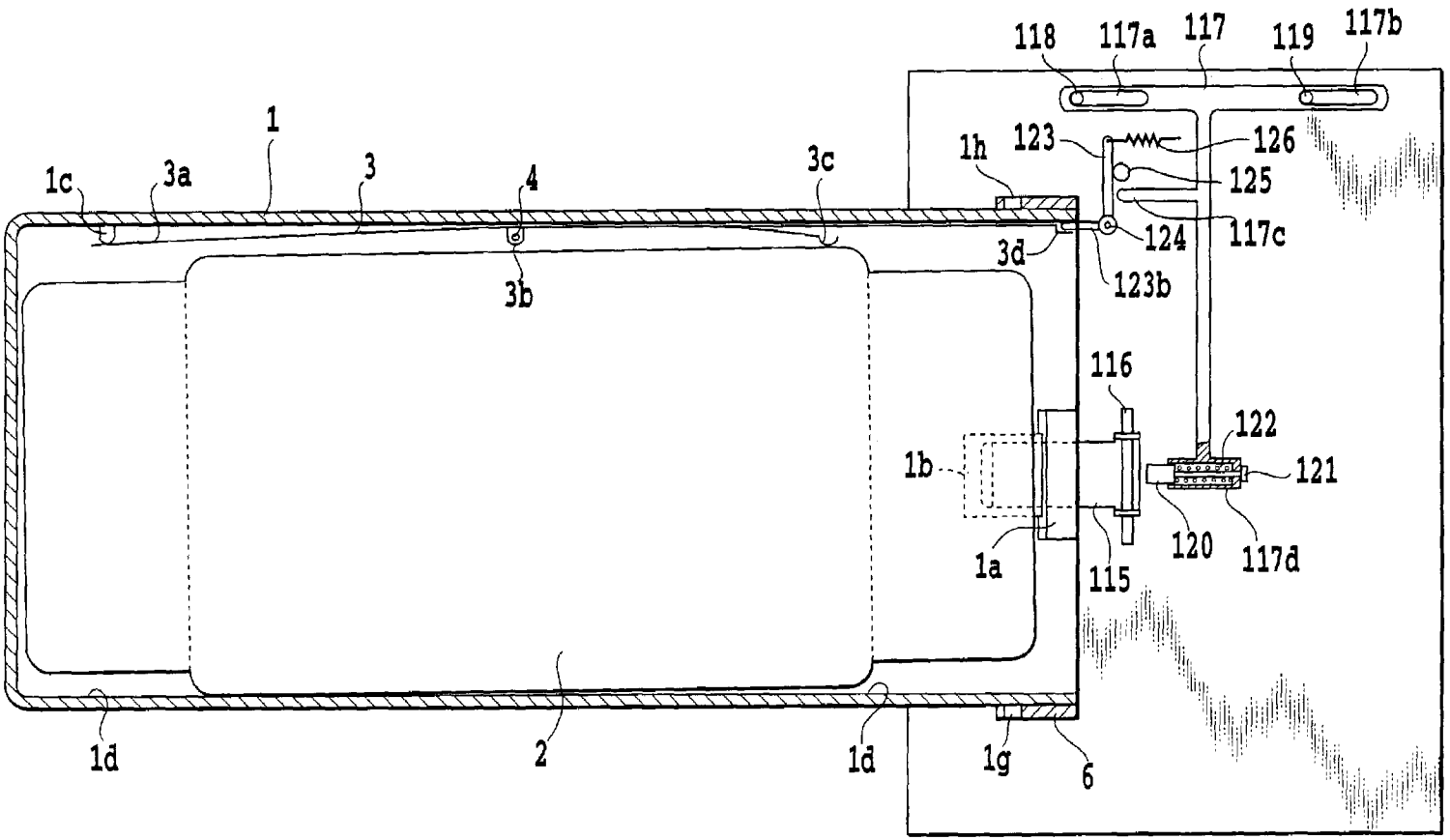
FIG. 4 is a view illustrating the operation of the biasing plate.

FIGS. 3 and 4 show a condition that the sheet cartridge case 1 is installed in the printer chassis 101. In FIGS. 3 and 4, the sheets 2 are shown being narrower at their right and left ends than in their center in the figure and having round corners. Further, a similar shape is also shown in FIGS. 5 and 6. This is because after on the center of each sheet 2 printing has been performed, both ends are cut off from the center, which has been printed, using perforations 2A. However, of course, the application of the present invention is not affected by such a sheet shape. It is apparent from the above description that the present invention is applicable to, for example, rectangular sheets normally used.

In the condition shown in FIGS. 3 and 4, the biasing portion 3*c* of the biasing plate 3 is not ready to bias the printing sheets 2. Accordingly, the position of the printing sheets 2 varies. For example, the sheets 2 may be set against a reference surface 1*d* formed by the case of the cartridge 1 as shown in FIG. 3 or may be separated from the reference surface 1*d* of the case 1 as shown in FIG. 4. In particular, the sheet feeding roller often performs a sheet feeding operation on the sheets inclined as shown in FIG. 4 and feeds them to a conveying section such as the conveying roller 102 without eliminating the inclination. If these sheets are printed, the print position is inclined relative to the sheets.

To prevent such a problem, the present embodiment biases the printing sheets 2 after the sheet cartridge 1 has been installed and immediately before the sheet feeding roller 112 starts a sheet feeding operation. That is, it is important to perform this biasing operation before pressing force acts on the sheets 2, the pressing force being exerted by the pressure plate 115 to press the sheets 2 against the sheet feeding roller 112.

In FIG. 3, first, a driving mechanism such as the motor 127 is used to move the slide plate 117 leftward in the figure. Accordingly, the driving portion 117*c* of the slide plate 117 pushes the arm 123*a* of the lever 123 to rotate the lever 123 counterclockwise against the tension spring 126 as shown in FIG. 5. Thus, the connecting portion 123*b* of the lever 123 pushes the interlocking portion 3*d* of the biasing plate 3 downward in the figure. That part of the biasing plate 3 which is present to the right of the shaft 4 rotates clockwise against the force exerted as the set spring portion 3*a* is urged counterclockwise. In conjunction with this rotation, the biasing portion 3*c* rotates clockwise. As a result, the biasing portion 3*c* urges the printing sheets 2 to press them against the reference surface 1*d* of the case 1.

In FIG. 5, in which the sheets 2 are pressed against the reference surface, the pressing member 120 is abutted against the pressure plate 115 as a result of the movement of the slide plate 117. However, the sheets 2 have not been pressed against the sheet feeding roller 112 yet. It is thus possible to bias the sheets 2 easily as shown in FIG. 5, even with the relatively weak pressing force of the biasing portion 3*c*.

Then, in the condition shown in FIG. 5, when the slide lever 117 is moved further leftward, the condition shown in FIG. 6 is established. In the condition shown in FIG. 6, the leftward movement of the slide plate 117 rotates the lever 123 further counterclockwise to push the interlocking portion 3*d* of the biasing plate 3 further downward. However, since the length between the shaft 4 and the interlocking portion 3*d* of the biasing plate 3 is set to be relatively large, the force exerted by the biasing portion 3*c* to press the sheets 2 is not substantially increased. In conjunction with the operation of the biasing plate 3, the pressing member 120 moves leftward to rotate the pressure plate 115 to the condition shown in FIG. 2. In this case, the force of the compression spring 122 of the holder portion 117*d* also acts to rotate the pressure plate 115 to press the printing sheets 2 against the sheet feeding roller 112. The pushing force of the compression spring 122 is set so that the amount of rotation of the pressure plate 115 varies depending on the number of the printer sheets 2 housed in the sheet cartridge. That is, with a large number of printing sheets 2, the amount of compression effected by the compression spring 122 increases to press the printing sheets 2 with a stronger force. On the other hand, with a smaller number of printing sheets 2, the amount of compression effected by the compression spring 122 decreases to press the printing sheets 2 with a relatively weak force. Thus, a stable sheet feeding operation is possible even if the number of the printing sheets 2 changes.

Then, when rotating of the sheet feeding roller 112 feeds one of the printing sheets 2 in the condition shown in FIGS. 6 and 2 and the conveying roller 102 and the pinch roller 103 (FIG. 1) are ready to feed this printing sheet, i.e. when the sheet 2 is sandwiched between nip portions of the conveying roller 102 and the pinch roller 103, the motor 127 is driven in a controlled manner so as to move the slide plate 117 rightward. Thus, the slide plate 117 shifts from the condition shown in FIG. 6 back to the condition shown in FIG. 3. This stops the pressure plate 115 from pressing the printing sheets 2 upward and also stops the biasing plate 3 from biasing the printing sheets.

As described above, the biasing operation of the biasing plate 3 starts immediately before a sheet feeding operation is started and ends before the conveying force of the conveying roller in a conveying section acts on the sheet. Consequently, at least when the sheet is fed, its position such as its feeding direction can be regulated by exerting urging force on it. Further, the urging operation is performed immediately before the sheet is fed and not on the other occasions, particularly while it is housed before being fed. This prevents the deformation of the sheet or the like caused by the urging force.

Further, the urging operation is performed only during a sheet feeding operation and not while the sheet is subsequently conveyed and printed. Consequently, while the conveying roller and others are performing a conveying operation, the urging of the sheets by the biasing plate does not constitute resistance to the conveyance. This makes it possible to decrease conveying loads during printing.

Of course, a control section (not shown) drivingly controls the motor 127, used to drive the slide plate 117. As is well known, the control section is composed of a CPU, a ROM, a RAM, and others.

It should also be appreciated that the application of the present invention is not limited to the above described portable printer. It is apparent from the above description that the present invention is applicable to a printing apparatus such as a printer or a copier which is used in a normal office or the like. Further, the sheet feeding section need not necessarily be a cartridge. It may be a fixed sheet feeding mechanism of the printing apparatus or a general auto sheet feeder, which is removably used in the printing apparatus.

According to the above embodiment, the cartridge that can be installed in and removed from the printer has the presser spring used to bias the printer sheets from the direction perpendicular to the conveying direction. The presser spring acts on the sheets immediately before a sheet feeding operation is performed take one of the sheets out of the sheet cartridge. Consequently, the sheets are not curled in spite of the urging force of the biasing spring. It is thus possible to carry out accurate printing without reducing printing accuracy.

Further, the presser spring, which biases the sheets from the direction perpendicular to the conveying direction, starts acting on the sheets immediately before a sheet feeding operation is performed take one of the sheets out of the sheet cartridge. The presser spring then ends this action immediately after the sheet feeding operation has been completed, when the conveying roller of the printer starts conveying the sheet. This hinders conveying resistance from being increased during printing, thus reducing the power consumption of the conveying motor and others. Further, the conveying resistance is prevented from being nonuniform, thus improving the printing accuracy. Furthermore, the urging force of the biasing spring also acts, only for a minimum time, on the sheets stacked in the sheet cartridge in a print standby condition. This makes it possible to prevent the sheets in the print standby condition from being curled.

Furthermore, after the sheet cartridge has been removed from the printer, the presser spring, which biases the sheets from the direction perpendicular to the conveying direction, does not act on the sheets. Consequently, even when the sheets are stored for a long time without being used or under hot and humid conditions, they can be prevented from being markedly curled or bent.

Further, ink the amount of which is sufficient to print the sheets installed in the printer is housed in the cartridge that can be installed in and removed from the printer. In this case, the cartridge also has the presser spring used to bias the printer sheets from the direction perpendicular to the conveying direction. Further, the presser spring acts on the sheets immediately before a sheet feeding operation is performed take one of the sheets out of the sheet cartridge. Consequently, the sheets are not curled in spite of the urging force of the biasing spring. It is thus possible to carry out accurate printing without reducing printing accuracy.

As described above, according to the embodiment of the present invention, the urging operation is performed to urge the printing sheets fed by the sheet feeding mechanism, in the direction different from the sheet feeding direction to press them against the predetermined reference surface. This urging operation is started at least before one of the sheets is conveyed so as to allow the sheet feeding mechanism to feed it. Preferably, this operation is performed at least until the conveying means starts conveying the sheet. Consequently, at least when the sheet is fed, its position such as its feeding direction can be regulated by exerting urging force on it. Further, it is possible that the urging operation is performed immediately before the sheet is fed and not on the other occasions, particularly while it is housed before being fed.

As a result, the spring or the like can be used to properly regulate the sheet feeding position such as the sheet feeding direction. Further, the sheets are not deformed in spite of the urging force of the spring or the like. Furthermore, it is possible to prevent a required conveying force from being increased after sheet feeding.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A printing apparatus performing printing on a sheet, said printing apparatus comprising:

a sheet containing portion for containing sheets;

a sheet feeding mechanism for feeding sheets in a feeding direction contained by said sheet containing portion toward said conveying mechanism;

urging means for urging the sheet contained in said sheet containing portion in a direction different from the feeding direction of the sheet so as to press said sheet against a predetermined reference surface;

control means for controlling said urging means so that said urging means does not urge the sheet in a print standby condition and said urging means urge the sheet against the reference surface when said sheet feeding mechanism exerts feeding; and a conveying mechanism for conveying the sheet fed by said sheet feeding mechanism.

2. The printing apparatus as claimed in claim 1, wherein printing is performed using a printing head of ejecting ink to perform printing by ejecting ink to the sheet.

3. The printing apparatus as claimed in claim 2, wherein ink to be supplied to the printing head is further housed in the sheet cartridge.

4. The printing apparatus as claimed in claim 1, wherein said control means controls said urging means so that said urging means perform urging at least until the conveying mechanism starts conveying of the sheet.

5. The printing apparatus as claimed in claim 1, wherein said urging means includes a spring member and a driving member for driving said spring member, the sheet feeding mechanism includes a feed roller and a pressure plate for pressing the sheet against the feeding roller, and the driving member of said urging means moves to deform the spring member so that the spring member abuts against a sheet cartridge case, said urging causing the pressure plate to be deformed and press the sheet against the feeding roller so that it is allowed to perform conveying of the sheet for feeding by the feeding roller.

6. The printing apparatus as claimed in claim 5, wherein the conveying mechanism includes a conveying roller and a pinch roller for pressing the sheet against the conveying roller, and said control means controls said urging means so that said urging means performs urging at least until the sheet is sandwiched between a nip portion of the conveying roller and the pinch roller.

7. A printing apparatus using a sheet cartridge, in which sheet are housed and which is installed in said printing apparatus, performing printing on a sheet, said printing apparatus comprising:

a sheet feeding mechanism for feeding sheets in a feeding direction contained by said sheet containing portion toward said conveying mechanism;

urging means for urging the sheet contained in said sheet cartridge in a direction different from a feeding direction of the sheet so as to press said sheet against a predetermined reference surface; and control means for controlling said urging means so that said urging means does not urge the sheet in a print standby condition and said urging means urge the sheet against the reference surface when said sheet feeding mechanism exerts feeding; and a conveying mechanism for conveying the sheet fed by said sheet feeding mechanism.

8. A printing apparatus using a sheet cartridge, in which sheets are housed and which is installed in said printing apparatus, performing printing on a sheet, said printing apparatus comprising:

a sheet feeding mechanism for feeding sheets in a feeding direction contained by said sheet containing portion toward said conveying mechanism;

pressure means for pressing sheets contained in said sheet cartridge against said sheet feeding mechanism;

urging means for urging the sheets contained in said sheet cartridge in a direction different from the feeding direction of the sheet so as to press said sheet against a predetermined reference surface;

control means for controlling said urging means so that said urging means does not urge the sheet when said pressure means does not press the sheets contained in said sheet cartridge against said sheet feeding mechanism and said urging means urges the sheets when said pressure means presses the sheets contained in said sheet cartridge against said sheet feeding mechanism; and a conveying mechanism for conveying the sheet fed by said sheet feeding mechanism.

9. A sheet cartridge in which sheets are housed and which is used by a printing apparatus performing printing on a sheet, said cartridge comprising:

urging means for urging the sheets contained in said sheet cartridge in a direction different from the feeding direction of the sheet so as to press said sheet against a predetermined reference surface;

wherein said urging means have an engage portion for engaging with an actuating member of said printing apparatus when said sheet cartridge is installed in said printing apparatus, said urging means are controlled by said actuating member so that said urging means does not urge the sheet in a print standby condition and said urging means urge the sheet against the reference surface when said sheet feeding mechanism exerts feeding, and said printing apparatus includes a sheet feeding mechanism and a conveying mechanism for conveying the sheet fed by said sheet feeding mechanism.

10. The sheet cartridge as claimed in claim 9, wherein printing is performed with ink supplied to a printing head used in the printing apparatus.

11. The sheet cartridge as claimed in claim 9, wherein said actuating member includes a feed roller and a pressure plate for pressing the sheet against the feeding roller, and the driving member of said urging means moves to deform and cause the spring member so that the spring member abuts against the sheet cartridge case, said urging causing the pressure plate to be deformed and press the sheet against the feeding roller so that it is allowed to perform conveying of the sheet for feeding by the feeding roller.

* * * * *

UNITED STATES PATENT AND TRADEMARK OFFICE

CERTIFICATE OF CORRECTION

PATENT NO. : 7,111,842 B2
APPLICATION NO. : 10/461350
DATED : September 26, 2006
INVENTOR(S) : Masakazu Taku It is certified that error appears in the above-identified patent and that said Letters Patent is hereby corrected as shown below:

COLUMN 2:
Line 44, “perform” should read --performs--.
Line 49, “sheet” should read --sheets--.

COLUMN 10:
Line 4, “take” should read --to take--.
Line 12, “take” should read --to take--.
Line 40, “take” should read --to take--.

COLUMN 11:
Line 19, “urge” should read --urges--.
Line 32, “perform” should read --performs--.
Line 53, “sheet” should read --sheets--.

COLUMN 12:
Line 1, “urge” should read --urges--.
Line 38, “have” should read --has--.
Line 41, “are” should read --being--.
Line 44, “urge” should read --urges--.

Signed and Sealed this

Eighteenth Day of March, 2008

JON W. DUDAS
*Director of the United States Patent and Trademark Office*